United States Patent [19]

Heitkamp et al.

[11] Patent Number: 4,585,627

[45] Date of Patent: Apr. 29, 1986

[54] PROCESS FOR THE CONCENTRATION OF URANIUM FROM SEA WATER

[75] Inventors: Dieter Heitkamp, Jülich; Peter Inden, Düsseldorf, both of Fed. Rep. of Germany

[73] Assignee: Kernforschungsanlage Julich GmbH, Fed. Rep. of Germany

[21] Appl. No.: 328,654

[22] Filed: Dec. 8, 1981

[30] Foreign Application Priority Data

Dec. 15, 1980 [DE] Fed. Rep. of Germany ..... 3047220

[51] Int. Cl.[4] ..... C02F 1/28

[52] U.S. Cl. ..... 423/6; 210/670; 210/682

[58] Field of Search ..... 210/670, 682; 423/6

[56] References Cited

U.S. PATENT DOCUMENTS

| | | | |
|---|---|---|---|
| 3,332,737 | 7/1967 | Kraus | 423/6 |
| 3,721,533 | 3/1973 | Riedel | 210/682 |
| 4,277,345 | 7/1981 | Heitkamp et al. | 423/6 |
| 4,293,527 | 10/1981 | Morgan et al. | 210/682 |
| 4,298,577 | 11/1981 | Ashtheimer et al. | 423/6 |

*Primary Examiner*—Ivars Cintins

*Attorney, Agent, or Firm*—Scully, Scott, Murphy & Presser

[57] ABSTRACT

A process for the selective concentration of uranium from sea water through chemical accumulation onto a solid adsorption medium, which does not necessitate any H+ions for regeneration, in particular onto titanium oxide hydrate and subsequent elution with a carbonate-containing eluent.

2 Claims, No Drawings

PROCESS FOR THE CONCENTRATION OF URANIUM FROM SEA WATER

BACKGROUND OF THE INVENTION

1. Field of the Invention

The present invention relates to a process for the selective concentration of uranium from sea water through chemical accumulation onto a solid adsorption medium, which does not necessitate any $H^+$ ions for regeneration, in particular onto titanium oxide hydrate and subsequent elution with a carbonate-containing eluent.

The concentration of uranium from sea water through the accumulation onto adsorption media such as titanium oxide hydrate or ion exchanger is not absolutely specific, in essence, there are also accumulated other cations which are present in the sea. Hereby, disruptive above all are the bivalent calcium and magnesium ions whose mole concentrations in seawater are higher by a factor of greater than $10^5$ relative to that of the uranium. Notwithstanding the significantly higher receiving tendency for uranium by the adsorption medium, there must be taken into account a quantitatively predominent accumulation of the above mentioned competitive ions on the titanium oxide hydrate, which will accumulate for example, from seawater, substantially more calcium and magnesium than uranium.

2. Discussion of the Prior Art

During the chemical separation of the accumulated heavy-metal ions and the regeneration of the adsorption medium, in the usual manner there are also again separated the accumulated ballast ions (in essence, particularly $CA^{++}$ ad $Mg^{++}$). Relative to the uranium, in which there alone is interest in the raw material recovery thereof, this is interconnected with a relatively high use of chemicals. This is valid, for example, for the elutriation of uranium-charged titanium oxide hydrate with 1M aqueous ammonium carbonate solution. During this process, in addition to the accumulated uranium, calcium and magnesium are almost completely elutriated by the adsorption medium. Independently of the already mentioned high use of chemicals, this has the additional disadvantage that calcium and magnesium are hereby precipitated as carbonate on the adsorption medium and thereby may possibly obstruct the adsorber surface to subsequent accumulating processes.

SUMMARY OF THE INVENTION

Accordingly, it is an object of the present invention to provide a process of the type described in which the use of chemicals is considerably reduced and the regeneration of the adsorption medium is improved.

The inventive process of the above-mentioned type which has been developed for this purpose is essentially characterized in that as an eluent there is utilized sea water which is treated with sufficient carbonate ions and which is freed of formed precipitates.

In the selective elutriation of uranium accumulated on adsorption media through carbonate solution there should be possibly separated from the adsorption medium only uranium under the formation of the carbonate complex, without the elutriation of its concurrently accumulated ballast ions, above all magnesium, calcium and sodium. For this purpose, the uranium elutriation pursuant to the invention is carried out in the presence of extensively the same ballast ion concentrations as are present in sea water. A prerequisite at all times is a precise adjustment of the $Co_3^{2-}$ concentration in the eluent which, at the third power, enters into the effectiveness of the elution.

The carbonate concentration can be increased only to such an extent as allowed by the solubility product of the basic magnesium carbonate, so that magnesium in the concentration present in the sea (0.056M) will remain in solution besides the carbonate. The waiver against the presence of calcium ions in the eluent solution must hereby be taken into allowance, since its solubility product with carbonate is still essentially lower than that for magnesium. Actual practice indicates, however, that the absence of calcium in the eluent will not result in any substantial losses in the selectivity of the uranium elutriation.

Pursuant to the invention, particularly through the addition of ammonium carbonate and alkali carbonate, there is utilized decalcinated sea water with a carbonate content of 0.025M up to 0.15M and a pH value in the range of 8.5 to 9 as the eluent since this solution contains practically all cations competing in accumulation and elutriation with uranium up to calcium in the same concentration as in sea water. This, besides the selectivity of the uranium separation, has the additional advantage that also the ion strength of the eluent is comparable with that of sea water. The complex forming constants $K_E'$ of the elutriation process, which depends upon the ion strength of the medium, remains thereby unchanged in magnitude also during the elutriation procedure.

The removal of the free calcium ions from sea water for the formation of the eluent is effected through carbonate precipitation, the adjustment of the required carbonate concentration, as well as of the pH value through the addition of a corresponding excess of ammonium carbonate or soda, in accordance with the pH value. The correct setting of the pH value is hereby essential for at least two reasons. Since the OH concentration enters into the solubility product of the basic magnesium carbonate, an excessively high pH value will lead to the precipitation of the magnesium from the eluent. On the other hand, the pH value should not drop excessively in order to extensively restrict the formation of hydrogen carbonate and the escape of forming $CO_2$ at the expense of the separated carbonate.

Interconnected with the inventive elutriation process are a series of advantages:

(1) Due to the selectivity of the elution, in essence, the limiting of the separating reaction to uranium, there is restrained the separation of magnesium, and extensively also of calcium, from the adsorber and the therewith associated carbonate precipitation of these two earth alkali carbonates at the adsorber. In this manner, the adsorber surface, also for the case of the carbonate elutriation, remains free of deposits and contaminations which could hinder the subsequent concentration processes.

(2) The process renders needless the use of large quantities of fresh water for the formation of the eluent. Concurrently, there is obviated the necessity to interpose, between the accumulation and elutriation phase, any washing processes with fresh water or even with completely deionized water. The processes usually serve the purpose of conducting the adsorber free of sea water into the elution bath in order to avoid carbonate precipitations in the instance of carbonate elutriation, or a pH increase through buffering and dilution in the case of acidic elutriation.

(3) Since magnesium and calcium separations or precipitations are extensively avoided, the use of chemicals for the uranium recovery drops considerably in contrast with the usual elution processes.

(4) The composition of the eluent is also more satisfactory from the standpoint of recovery of uranium from the eluent in a second concentrating stage through ion exchange extraction than for the usual uranium elutrations such as with about 1M carbonate solution. An ion exchange extraction of uranium of carbonate containing elutrate is possible through two ways: Through an ion exchange of the 4-times negatively charged uranyl tricarbonate complex or through cation exchange of the uranyl from the tricarbonate complex and binding to stronger complexed exchanger groups. Both extracting methods become easier the lower there is the carbonate concentration of the eluent. The anion exchanger extraction is then only effective when the concentration of free carbonate in the eluent lies below 0.15M. In the 1M carbonate eluents which are necessary in accordance with the state of the technology, the carbonate concentration must accordingly be reduce prior to the second concentrating step, an extensive requirement, which is inventively eliminated due to the carbonate concentration limited to 0.15M in the eluent.

Hereinbelow, there is described an example for elucidating the invention:

EXAMPLE A

In this example there is demonstrated the effectiveness of the described elution principle for titanium oxide hydrate, known as an adsorber for uranium from sea water.

The main ballast ions for the uranium adsorption from sea water are calcium and magnesium.

Dissolved in North Sea water (ph. 8.2; magnesium content 1300 mg/l and calcium content 400 mg/l) was so much solid sodium carbonate and ammonium carbonate, until the solution reached a carbonate content of 0.11M. Thereby the ratio in the quantity of sodium to ammonium carbonate was constantly so regulated that the pH value of the sea water solution remains fixed at about 8.5 to 8.8. The precipitates which predominantly contained calcium were filtered off.

With 200ml of a thusly produced solution with ion concentrations of 1120 mg Mg/l; 6 mg Ca/l; 0.11 mol carbonate/1 and pH 8.6, there were elutrated 0.9 grams (dry weight) of titanium oxide hydrate granulate of Harwell/England, which previously had taken up in a 3-day stirring contact with 10 l North Sea water 12 ug uranium, 25 mg calcium and 7 mg magnesium. The eluent solution contained after the elutriation 11 ug uranium, 8 mg calcium corresponding to 40 mg Ca/l and 220 mg Mg corresponding to 1120 mg Mg/l. This signifies that the elution conducted itself extensively selective with respect to uranium: 90% of the uranium was elutriated, in contrast therewith less than 30% of the calcium. For magnesium, within the range of measuring precision, there was not determined any elution.

What is claimed is:

1. In a process for the selective concentration of uranium from sea water through chemical accumulation on a solid adsorption medium of titanium oxide, which does not require $H^+$ ions for regeneration and subsequent elution with a carbonate-containing eluent; the improvement comprising the utilization of sea water as the eluent which is supplied with sufficient carbonate ions and thereby freed of precipitates.

2. Process as claimed in claim 1, wherein said sea water eluent is brought to a carbonate content of the solution of about 0.025M to a maximum of 0.15M and a pH value of about 8.5 to 9.0 through the addition of ammonium carbonate and sodium carbonate, and obtaining a clear solution through filtration of the precipitate predominantly constituted of calcium carbonate.

* * * * *